US011281123B2

(12) United States Patent
Nieda

(10) Patent No.: US 11,281,123 B2
(45) Date of Patent: Mar. 22, 2022

(54) ROTATOR, DEVELOPER CONTAINER, DEVELOPING DEVICE, PROCESS CARTRIDGE, AND IMAGE FORMING APPARATUS

(71) Applicant: Ricoh Company, Ltd., Tokyo (JP)

(72) Inventor: Hiroaki Nieda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/078,718

(22) Filed: Oct. 23, 2020

(65) Prior Publication Data

US 2021/0157254 A1 May 27, 2021

(30) Foreign Application Priority Data

Nov. 21, 2019 (JP) ..... JP2019-210203
Oct. 16, 2020 (JP) ..... JP2020-174499

(51) Int. Cl.
*G03G 15/08* (2006.01)

(52) U.S. Cl.
CPC ..... *G03G 15/0808* (2013.01)

(58) Field of Classification Search
CPC ..... G03G 15/0808
See application file for complete search history.

(56) References Cited

U.S. PATENT DOCUMENTS 6,470,163 B1 * 10/2002 Minagawa ..... G03G 15/0855 399/256
2009/0297178 A1 * 12/2009 Kakuta ..... G03G 15/0856 399/27
2010/0189469 A1 * 7/2010 Nozawa ..... G03G 15/0865 399/254
2013/0216250 A1 * 8/2013 Seki ..... G03G 15/0818 399/53
2013/0216278 A1 * 8/2013 Ogawa ..... G03G 15/0877 399/284
2019/0243284 A1 8/2019 Nieda
2019/0243285 A1 8/2019 Nieda
2019/0286011 A1 9/2019 Nieda et al.
2019/0361374 A1 11/2019 Nieda
2020/0166872 A1 5/2020 Kita et al.
2020/0166886 A1 5/2020 Saito et al.
2021/0080861 A1 * 3/2021 Shimizu ..... G03G 15/0856

FOREIGN PATENT DOCUMENTS

JP 2003-156927 5/2003
JP 2003-162134 6/2003
JP 2011-186198 9/2011

* cited by examiner

*Primary Examiner* — Sevan A Aydin
(74) *Attorney, Agent, or Firm* — Xsensus LLP

(57) ABSTRACT

A rotator includes a rotation shaft, a first radial flap, a second radial flap, and a holder. The first radial flap extends from the rotation shaft in a first radial direction, and the second radial flap extends from the rotation shaft in a second radial direction. The holder holds the first radial flap and the second radial flap and includes a support face and a hole. The support face faces toward a rotation direction of the rotator and is configured to fix the first radial flap by thermal caulking. The hole is configured to insert a part of the second radial flap to hold the second radial flap.

12 Claims, 9 Drawing Sheets

ROTATOR, DEVELOPER CONTAINER, DEVELOPING DEVICE, PROCESS CARTRIDGE, AND IMAGE FORMING APPARATUS

CROSS-REFERENCE TO RELATED APPLICATIONS

This patent application is based on and claims priority pursuant to 35 U.S.C. § 119 to Japanese Patent Applications No. 2019-210203, filed on Nov. 21, 2019 and No. 2020-174499, filed on Oct. 16, 2020 in the Japan Patent Office, the entire disclosures of which are hereby incorporated by reference herein.

BACKGROUND

Technical Field

Embodiments of the present disclosure generally relate to a rotator that is used as a stirrer, a developer container including the rotator, a developing device and a process cartridge each that include the developer container, and an image forming apparatus, such as a copier, a printer, a facsimile machine, or a multifunction peripheral (MFP) having one or more such functions, that is adapted to incorporate the developing device or the process cartridge.

Background Art

In an image forming apparatus such as a copier, a printer, and a facsimile, a technology is known in which a rotator serving as a stirrer having a flexible member such as a plastic film serving as a stirring blade rotates about a rotation shaft and stirs toner in a toner container or a developing device.

SUMMARY

This specification describes a rotator that includes a rotation shaft, a first radial flap, a second radial flap, and a holder. The first radial flap extends from the rotation shaft in a first radial direction, and the second radial flap extends from the rotation shaft in a second radial direction. The holder holds the first radial flap and the second radial flap and includes a support face and a hole. The support face faces toward a rotation direction of the rotator and is configured to fix the first radial flap by thermal caulking. The hole is configured to insert a part of the second radial flap to hold the second radial flap.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
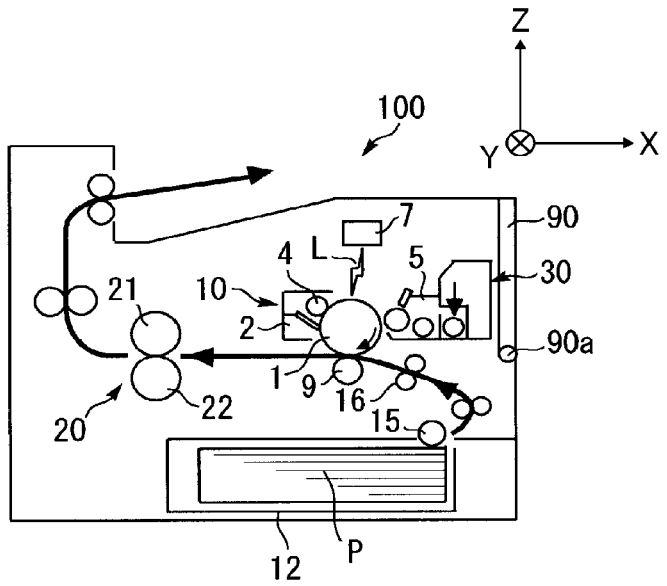
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure, and all of the components or elements described in the embodiments of this disclosure are not necessarily indispensable.

With reference to the drawings, embodiments of the present disclosure are described below. Identical reference numerals are assigned to identical components or equivalents and a description of those components is simplified or omitted.

With reference to FIG. 1, a configuration and operation of an image forming apparatus 100 is described below.

In FIG. 1, the image forming apparatus 100 that is a printer in the present embodiment includes a photoconductor drum 1 on which a toner image is formed, and an exposure device (or a writing device) 7 that irradiates the photoconductor drum 1 with exposure light L based on image data input from an input device such as a personal computer.

The image forming apparatus 100 further includes: a transfer roller 9 to transfer a toner image borne on a surface of the photoconductor drum 1 onto a sheet P conveyed to a transfer nip (i.e. a transfer position); a process cartridge 10 in which the photoconductor drum 1, a charging roller 4, a developing device 5, a cleaner 2, and a waste toner conveyor 6 (see FIG. 2) are united; and a sheet feeder (or a sheet tray) 12 to accommodate the sheets P such as paper sheets.

The image forming apparatus 100 yet further includes a registration roller pair (or a timing roller pair) 16 to feed the sheet P toward the transfer nip where the photoconductor drum 1 contacts the transfer roller 9, a fixing device 20 to fix an unfixed image on the sheet P, and a toner container 30. The fixing device 20 includes a fixing roller 21 and a pressure roller 22.

The above-described image forming apparatus 100 includes a charging roller 4, a developing device 5, a cleaner 2, a waste toner conveyor 6, and the like around the photoconductor drum 1. The above components (i.e., the photoconductor drum 1, the charging roller 4, the developing device 5, the cleaner 2, and the waste toner conveyor 6) are united as the process cartridge 10. The process cartridge 10 as a removable unit is removably installed in the image forming apparatus 100 and is replaceable. The process cartridge 10 is replaced with a new process cartridge in a certain replacement cycle.

The toner container 30 is set on the developing device 5 of the process cartridge 10 to be able to remove from or installed in the main body of the image forming apparatus 100, that is, to be replaceable. The toner container 30 includes a toner storage 31 (see FIG. 2) to store fresh toner. The toner is appropriately supplied from the toner container 30 to the inside of the developing device 5. When the toner container 30 runs out of toner (or toner contained in the developing device 5 is depleted), the toner container 30 is replaced with a new toner container. The toner container 30 according to the present embodiment further includes a waste toner collection portion 32 (see FIG. 2) to collect waste toner in addition to the toner storage 31 to store fresh toner. The waste toner collection portion is described in detail below.

Figure 2:
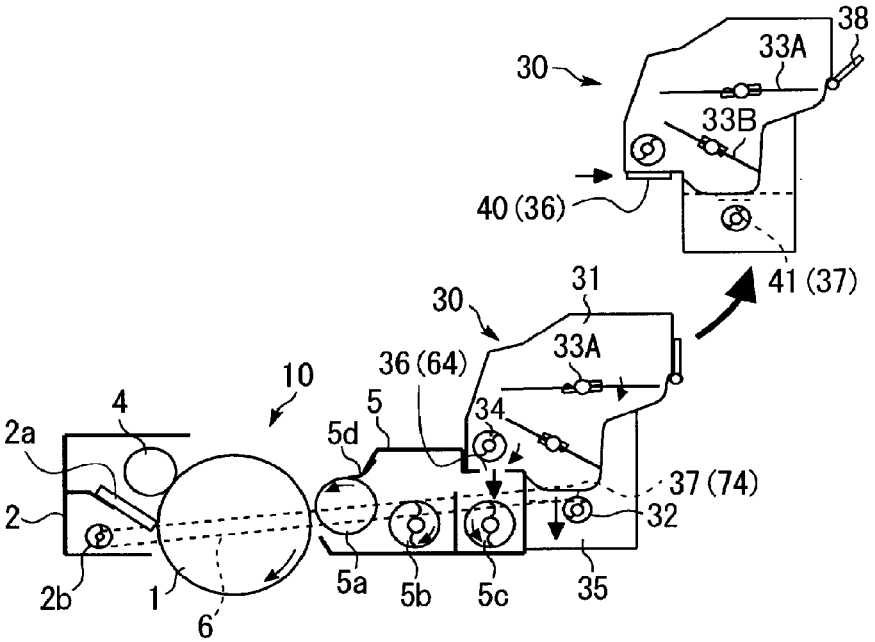
FIG. 2 is a schematic view illustrating a process cartridge and a toner container according to an embodiment of the present disclosure.

Now, a description is given of the image forming operations performed by the image forming apparatus 100 with reference to FIGS. 1 and 2.

With reference to FIG. 1, the input device such as the personal computer sends the image data to the exposure device 7 in the image forming apparatus 100, and the exposure device 7 irradiates the surface of the photoconductor drum 1 with the exposure light (or a laser beam) L based on the image data.

The photoconductor drum 1 rotates in a direction indicated by arrow in FIG. 1, that is, a clockwise direction. Initially, the charging roller 4 uniformly charges the surface of the photoconductor drum 1 opposite the charging roller 4, which is called a charging process. As a result, a charging potential is formed on the surface of the photoconductor drum 1. In the present embodiment, the charging potential on the photoconductor drum 1 is approximately −900 V. The charged surface of the photoconductor drum 1 thereafter reaches a position to receive the exposure light L. An electric potential at the position that receives the exposure light L serves as a latent image potential (of about 0 to −100 V), and an electrostatic latent image is formed on the surface of the photoconductor drum 1, which is called an exposure process.

The surface of the photoconductor drum 1 bearing the electrostatic latent image thereon then reaches a position opposite the developing device 5. The developing device 5 supplies toner onto the photoconductor drum 1, and the latent image formed on the photoconductor drum 1 is thereby developed into a toner image, which is called a developing process.

As illustrated in FIG. 2, the developing device 5 includes a developing roller 5*a*, two development conveying screws 5*b* and 5*c*, and a doctor blade 5*d*. The developing device 5 contains toner, that is, one-component developer. The toner is supplied from a discharge port 36 of the toner container 30 (or the toner storage 31) to the developing device 5 via an inlet port 64 of the developing device 5 according to consumption of toner in the developing device 5. The two conveying screws 5*b* and 5*c* stir and mix the supplied toner with the toner contained in the developing device 5 while circulating the toner in a longitudinal direction of the developing device 5, which is a direction perpendicular to the surface of the paper on which FIG. 2 is drawn. The developing roller 5*a* scoops up a part of the toner conveyed by the conveying screw 5*b*. The toner scooped up by the developing roller 5*a* is regulated by the doctor blade 5*d* and reaches a position opposite the photoconductor drum 1 that is called a developing range. The doctor blade 5*d* rubs the toner on the developing roller 5*a* and triboelectrically charges the toner. The regulated toner adheres to the electrostatic latent image on the photoconductor drum 1 in the developing range, thereby forming the toner image on the photoconductor drum 1. A drive motor disposed in the main body of the image forming apparatus 100 rotates the developing roller 5*a* and the two conveying screws 5*b* and 5*c* in directions indicated by arrows in FIG. 2.

After the developing process, the surface of the photoconductor drum 1 bearing the toner image thereon reaches the transfer nip (i.e. the transfer position) formed between the photoconductor drum 1 and the transfer roller 9. In the transfer nip, a transfer bias having an opposite polarity to toner is applied from a power source to the transfer roller 9, and the toner image formed on the photoconductor drum 1 is thereby transferred onto the sheet P fed by the registration roller pair 16, which is called a transfer process.

The surface of the photoconductor drum 1 after the transfer process reaches a position opposite the cleaner 2. At the position opposite the cleaner 2, a cleaning blade 2*a* mechanically removes untransferred toner remaining on the surface of the photoconductor drum 1, and removed toner is collected in the cleaner 2, which is called a cleaning process.

A series of image forming processes on the photoconductor drum 1 is thus completed.

The untransferred toner collected in the cleaner 2 is conveyed by a collection screw 2*b* to one end of the cleaner 2 in a width direction that is a rotation axis direction of the collection screw 2*b*, conveyed in a diagonally upper right direction in FIG. 2 by the waste toner conveyor 6 including a waste toner coil 6*a*, and collected as waste toner from an outlet port 74 of the waste toner conveyor 6 to the inside of the waste toner collection portion 32 of the toner container 30 via a collection port 37 of the toner container 30.

In the new toner container 30, the toner storage 31 is filled with fresh toner, and the waste toner collection portion 32 is empty.

The sheet P is conveyed to the transfer nip (i.e., the transfer position) between the photoconductor drum 1 and the transfer roller 9 as follows.

First, a feed roller 15 feeds the sheet P stored at the top in the sheet feeder 12 toward a conveyance passage.

The sheet P thereafter reaches the position of the registration roller pair 16. The sheet P is fed from the position of the registration roller pair 16 to the transfer nip (i.e., contact position of the transfer roller 9 with the photoconductor drum 1) in synchronization with an entry of the toner image formed on the photoconductor drum 1 into the transfer nip.

After the transfer process, the sheet P passes through the transfer nip (i.e., the position of the transfer roller 9) and reaches the fixing device 20 through the conveyance passage. In the fixing device 20, the sheet P is interposed between the fixing roller 21 and the pressure roller 22. The toner image is fixed on the sheet P by heat applied from the fixing roller 21 and pressure applied from both of the fixing roller 21 and the pressure roller 22. After the sheet P having the fixed toner image thereon is ejected from the fixing nip formed between the fixing roller 21 and the pressure roller 22, the sheet P is ejected from the body of the image forming apparatus 100 and stacked on an output tray.

Thus, a series of the image forming processes is completed.

Figure 3A:
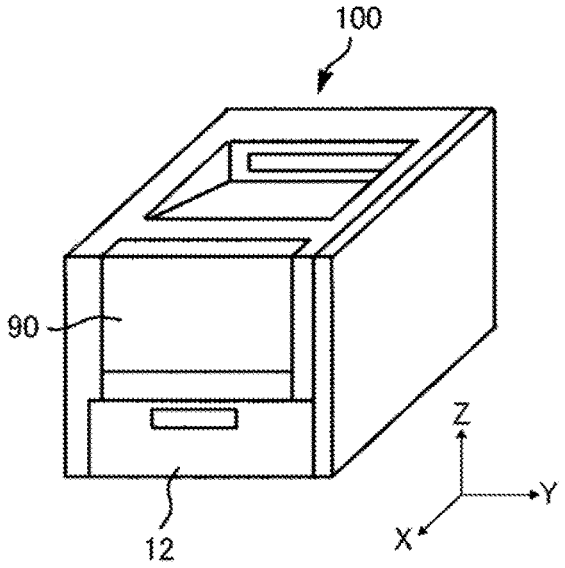
FIG. 3A is a perspective view of the image forming apparatus of FIG. 1.
Figure 3B:
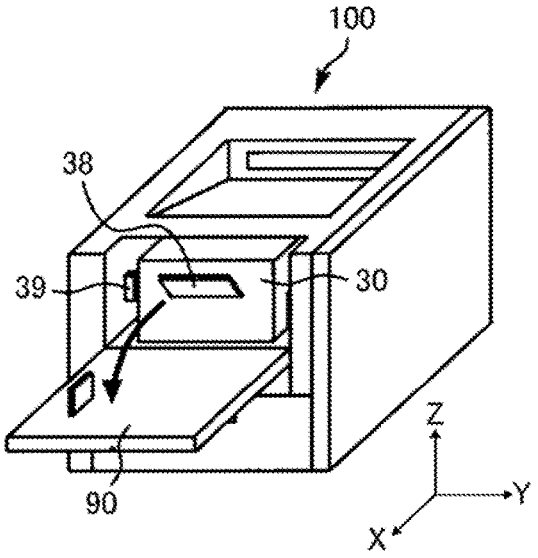
FIG. 3B is a perspective view of the image forming apparatus of FIG. 1 with a cover open.

According to the present embodiment, the image forming apparatus 100 is covered with a plurality of exterior covers as illustrated in FIG. 3A. As illustrated in FIG. 3B, a part of a front exterior cover functions as a cover 90 that is rotatably opened and closed.

Specifically, the cover 90 is secured to the main body of the image forming apparatus 100 and hinged around a spindle 90*a* as a rotation axis as illustrated in FIG. 1. As the cover 90 rotates counterclockwise in FIG. 1 around the spindle 90*a*, the cover 90 closes as illustrated in FIGS. 1 and 3A. As the cover 90 rotates clockwise in FIG. 1 around the spindle 90*a*, the cover 90 opens as illustrated in FIG. 3B.

Figure 4:
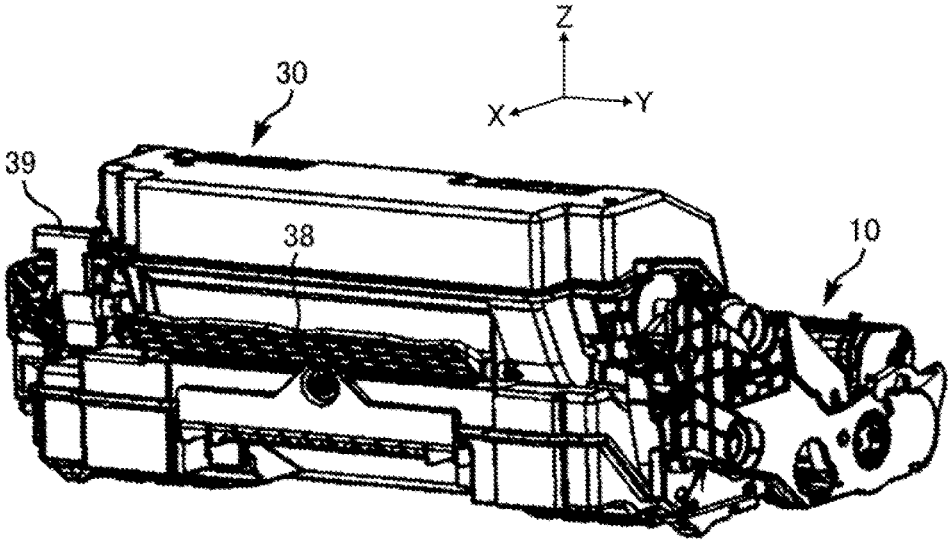
FIG. 4 is a perspective view of the process cartridge of FIG. 2 to which the toner container is attached.
Figure 7:
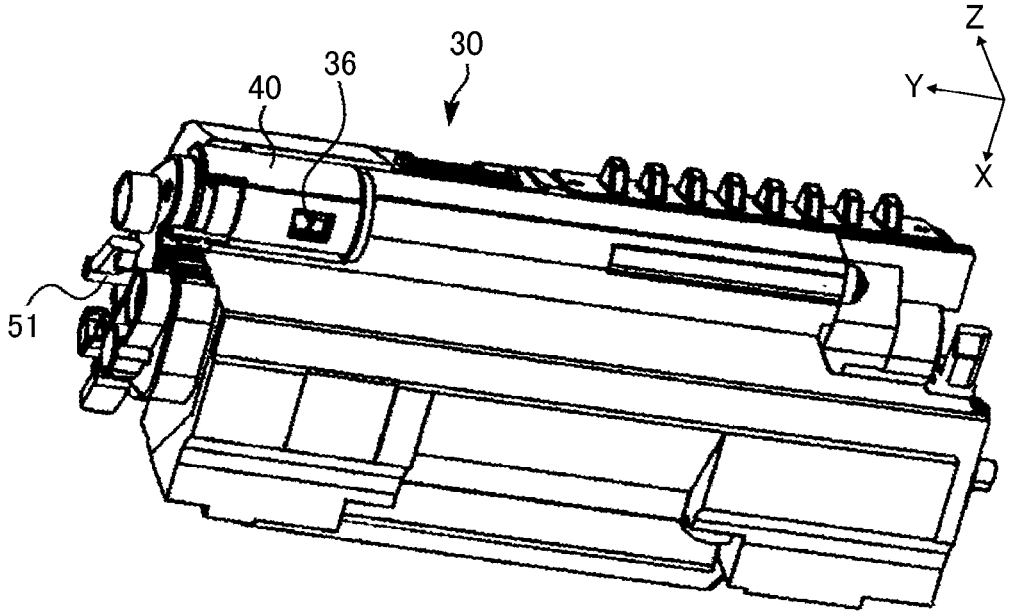
FIG. 7 is a perspective view of the toner container of FIG. 2 when viewed from below with a first shutter (a discharge port) opened.

In the present embodiment, the cover 90 opened as illustrated in FIG. 3B reveals the toner container 30 to be installable in and removable from the main body of the image forming apparatus 100. Opening the cover 90 enables replacing only the toner container 30 as illustrated in FIG. 7 with a new toner container or, alternatively, replacing the toner container 30 together with the process cartridge 10 with a new one that is the process cartridge 10 and the toner container 30 as illustrated in FIG. 4. When the cover 90 closes as illustrated in FIG. 1, image forming processes that are printing operations described above with reference to FIG. 1 are performed.

The configuration and operations of the toner container 30 according to the present embodiment are described in detail below.

In the present embodiment, as illustrated in FIG. 2, the toner container 30 is detachably attachable to the process cartridge 10. In particular, in the present embodiment, the toner container 30 is attachable to and detachable from the process cartridge 10 in both states in which the process cartridge 10 is installed in the image forming apparatus 100 and in which the process cartridge 10 is removed from the image forming apparatus 100.

As described above with reference to FIG. 3B, the toner container 30 is attachable to and detachable from the process cartridge 10 installed in the image forming apparatus 100. In other words, the toner container 30 is indirectly installable in and removable from the image forming apparatus 100.

In the present embodiment, the toner container 30 is indirectly installable in and removable from the image forming apparatus 100. Alternatively, the toner container 30 may be directly installable in and removable from the image forming apparatus 100.

The process cartridge 10 is the removable unit that is removably installable in the image forming apparatus 100. In addition to the process cartridge 10, the developing device 5 and other devices may function as the removable unit. The toner container 30 may be attachable to and detachable from the removable unit other than the process cartridge 10.

Figure 5:
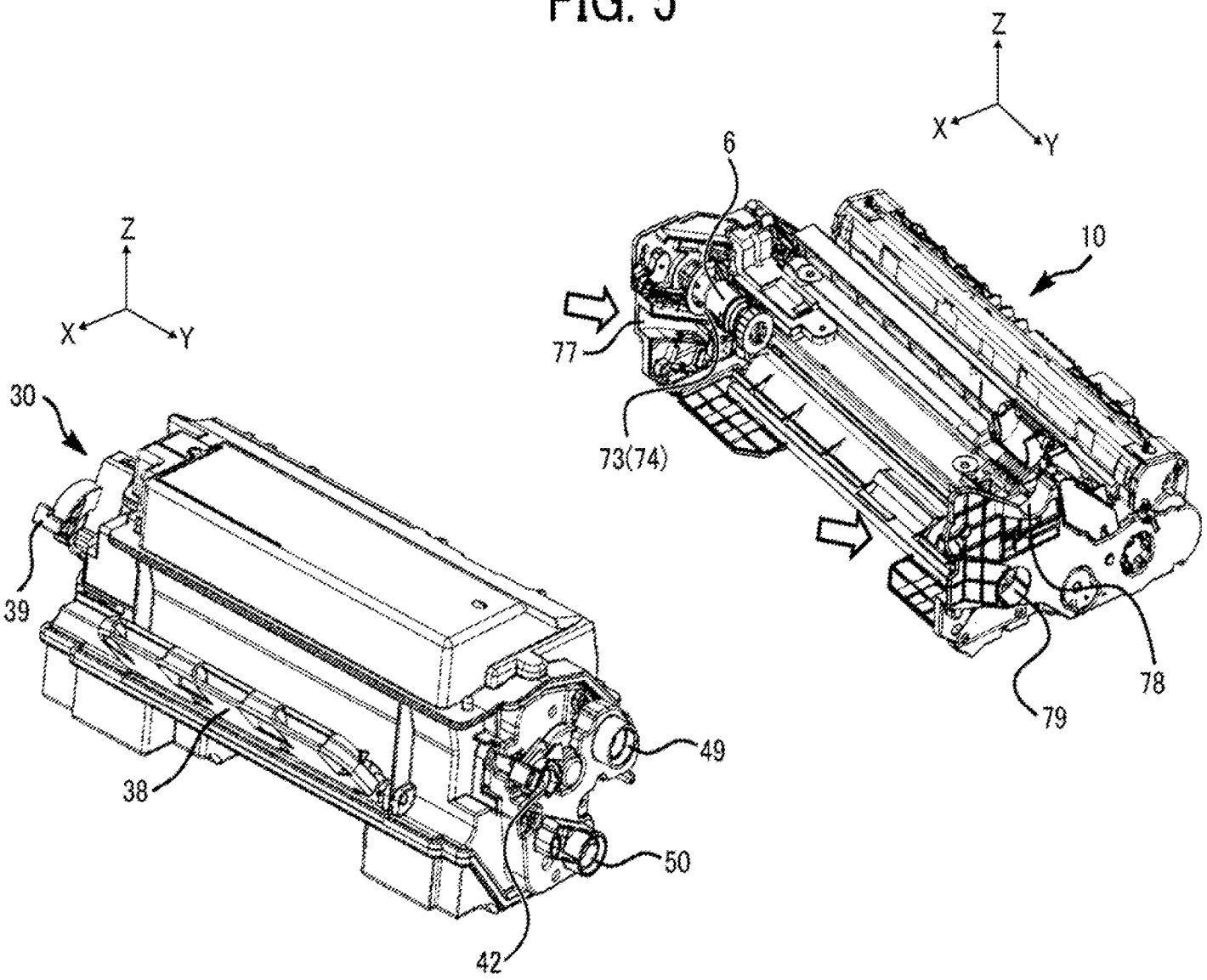
FIG. 5 is a perspective view of the process cartridge of FIG. 4 from which the toner container is detached.
Figure 6A:
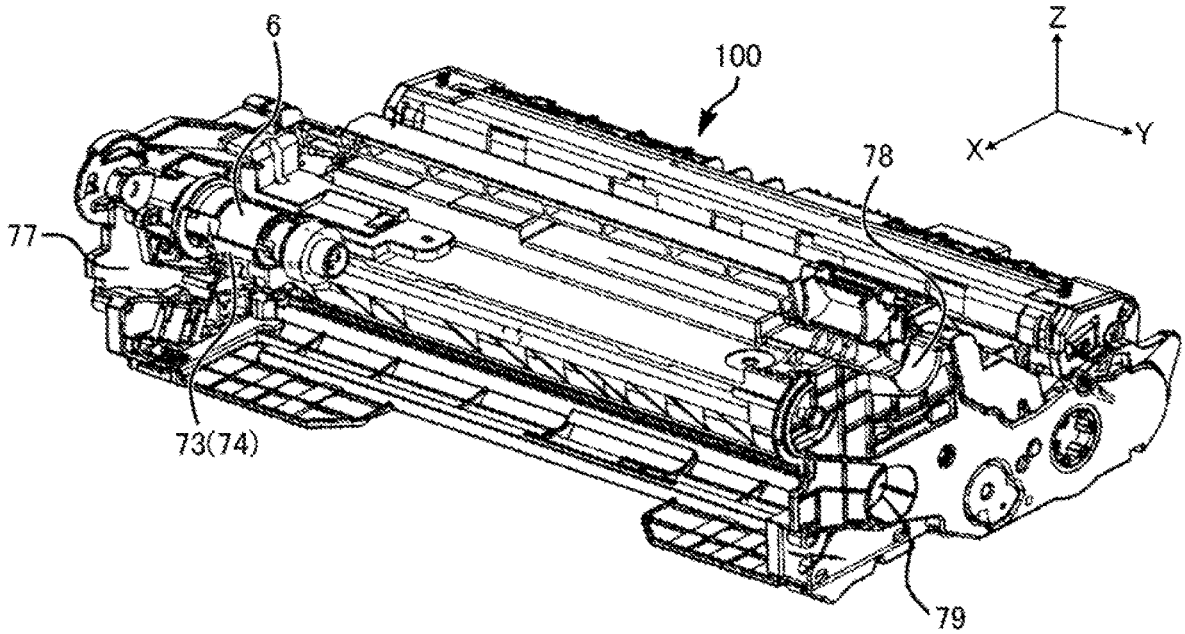
FIGS. 6A and 6B are perspective views of the process cartridge of FIG. 5.
Figure 6B:
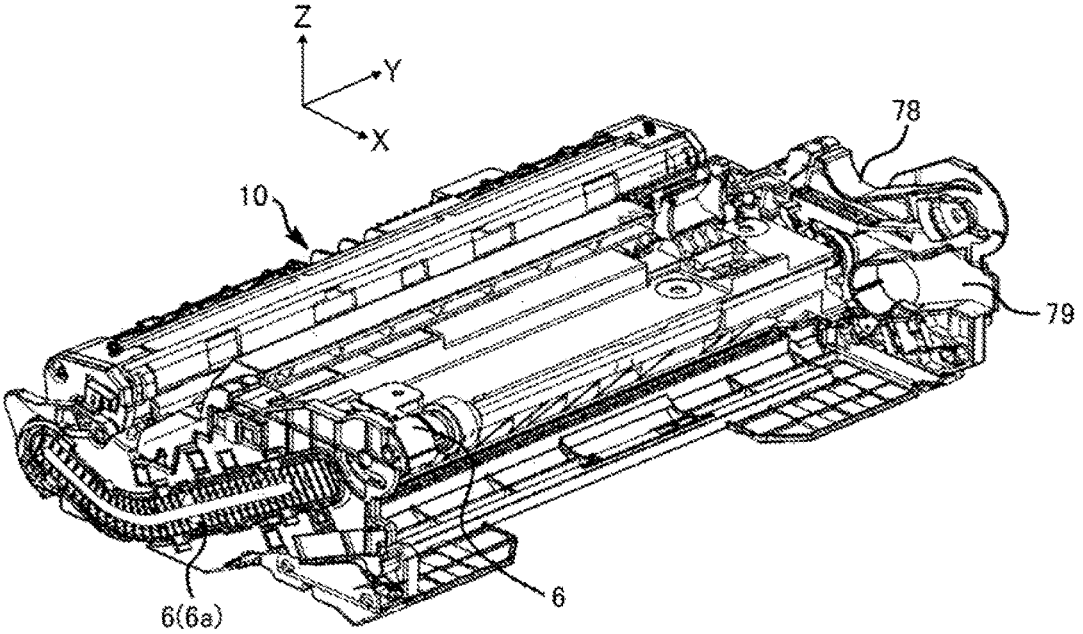

In addition, as illustrated in FIG. 4, the toner container 30 attached to the process cartridge 10 is installable in and removable from the image forming apparatus 100 as a single removable unit. As illustrated in FIG. 5, an operator such as a user moves the toner container 30 in a predetermined direction indicated by fat arrows in FIG. 5 to set the toner container 30 on the process cartridge 10 and moves the toner container 30 in a direction opposite the predetermined direction to remove the toner container 30 from the process cartridge 10. The toner container 30 alone as illustrated in FIG. 7 is distributed in the market. The process cartridge 10 alone as illustrated in FIGS. 6A and 6B is similarly distributed in the market.

The toner container 30 includes a handle 38 disposed on the front side of the toner container 30 in a direction of detachment operation, that is, a positive X-direction as illustrated in FIGS. 2 to 5. The operator such as the user grips the handle 38 to pull the toner container 30 out of the process cartridge 10 (or the image forming apparatus 100) or push the toner container 30 into the process cartridge 10 (or the image forming apparatus 100) when the toner container 30 is attached to or detached from the process cartridge 10 (or the image forming apparatus 100). The handle 38 is foldable. When the cover 90 closes in a state in which the toner container 30 is installed in the image forming apparatus 100 with the handle 38 standing up as illustrated in FIGS. 4 and 5, the handle 38 is pushed by the cover 90 in conjunction with movement of the cover 90 from an open state to a closed state, thereby accommodating the handle 38 along an exterior of the toner container 30.

Figure 8:
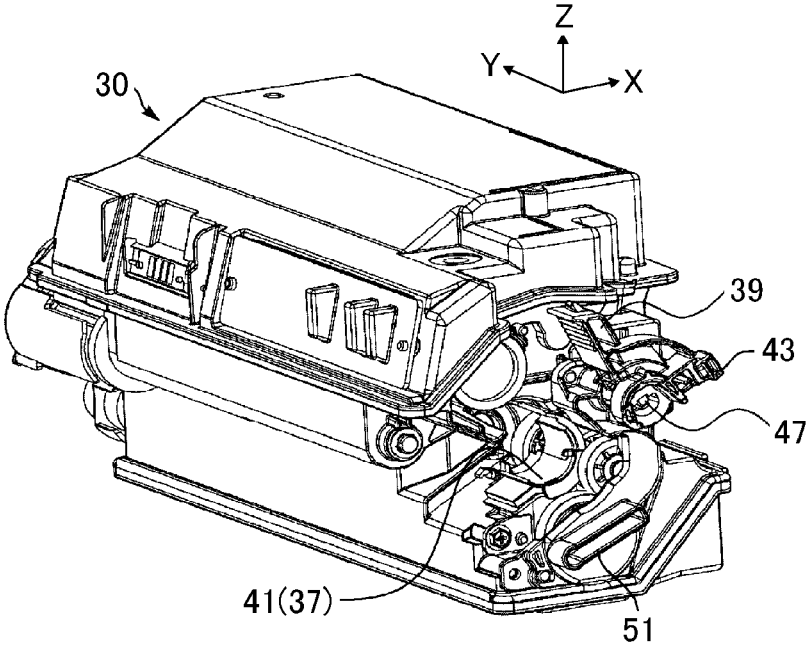
FIG. 8 is a perspective view of the toner container of FIG. 7 when viewed from the collection port side with a second shutter (a collection port) closed.

The toner container 30 includes a first positioning portion 49 and a second positioning portion 50 as illustrated in FIG. 5 and a guide 51 as illustrated in FIGS. 7 and 8. The process cartridge 10 includes a plurality of guide grooves 77 and 79 and a guide receiver 78. The first positioning portion 49, the second positioning portion 50, and the guide 51 engage with the multiple guide grooves 77 and 79 and the guide receiver 78, respectively. Thus, the toner container 30 can be attached to and detached from the process cartridge 10 and positioned in the process cartridge 10.

Specifically, the first positioning portion 49 and the second positioning portion 50 project from one end face of the toner container 30 in the width direction of the toner container 30 that is the positive Y-direction in FIG. 5 and form positioning projections. The guide receiver 78 and the guide groove 79 are disposed on one end face of the process cartridge 10 in the width direction of the process cartridge 10. The one end face of the process cartridge 10 corresponds to the one end face of the toner container 30. The guide 51 projects from the other end face of the toner container 30 in the negative Y-direction in FIG. 5 and has a rectangular shape which is inclined upward and extends in the positive X-direction in FIG. 8. The guide groove 77 is disposed at the other end face of the process cartridge 10 in the width direction of the process cartridge 10. The guide receiver 78 receives the first positioning portion 49, the guide groove 79 receives the second positioning portion 50, and the guide groove 77 receives the guide 51. Thus, the toner container 30 is attached to the process cartridge 10. The toner container 30 is positioned in the process cartridge 10 so that the first and second positioning portions 49 and 50 engage dead ends of the guide receiver 78 and the guide groove 79, respectively, and the guide 51 engages a dead end of the guide groove 77.

The first positioning portion 49 is a projection surrounding a coupling that transmits a driving force from the image forming apparatus 100 to a first stirrer 33A (see FIGS. 2 and 9) to stir toner. The driving force input to the first stirrer 33A is transmitted to the second stirrer 33B via an idle gear, and the first stirrer 33A and the second stirrer 33B rotate clockwise in FIG. 9.

Figure 9:
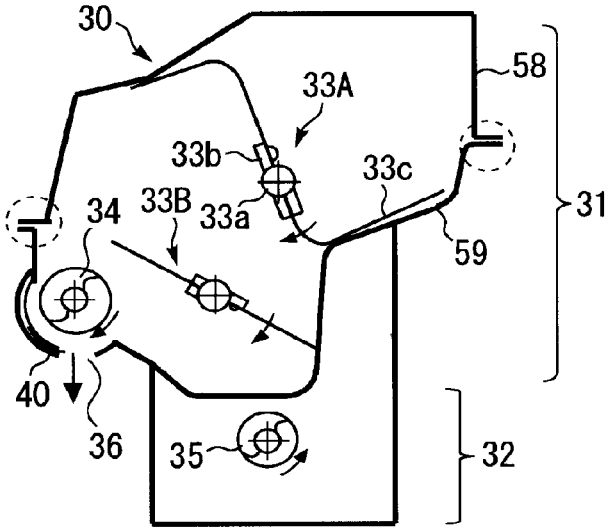
FIG. 9 is a schematic view illustrating an inside of the toner container of FIG. 7.

The second positioning portion 50 is a projection surrounding a coupling gear to rotate a waste toner conveying screw 35 (see FIGS. 2 and 9). As described above, input portions to receive the driving force from the image forming apparatus 100 are disposed near or inside the first positioning portion 49 and the second positioning portion 50, enabling reliable driving force transmission.

The toner container 30 includes the discharge port 36, a collection port 37, a first shutter 40, and a second shutter 41.

With reference to FIGS. 2, 7, and 9, the discharge port 36 of the toner container 30 is an opening to discharge toner stored in the toner storage 31 of the toner container 30 to the developing device 5. The discharge port 36 communicates with the inlet port 64 of the developing device 5 when the toner container 30 is attached to the process cartridge 10. The inlet port 64 is an opening disposed above the second conveying screw 5*c*.

Figure 10:
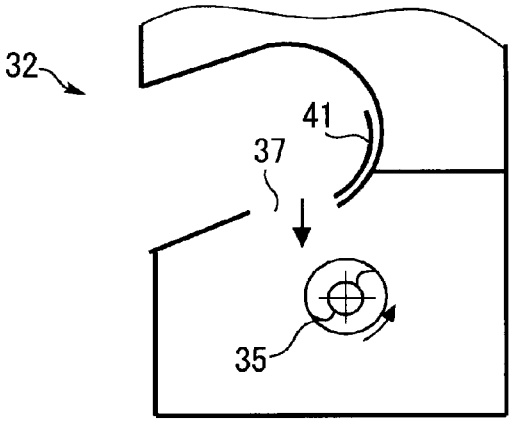
FIG. 10 is a schematic view illustrating a waste toner collection portion of the toner container of FIG. 2.

With reference to FIGS. 2, 8, and 10, the collection port 37 of the toner container 30 is an opening to receive waste toner (i.e. untransferred toner) from the outside of the toner container 30 and to collect the waste toner in the toner container 30. The collection port 37 communicates with the outlet port 74 of the waste toner conveyor 6 when the toner container 30 is attached to the process cartridge 10. The outlet port 74 (see FIGS. 5 and 6) is an opening disposed on a bottom face of a downstream end of the waste toner conveyor 6 in a direction of conveyance of the waste toner.

In the toner container 30 according to the present embodiment, with reference to FIGS. 2, 9, and 10, the toner storage 31 and the waste toner collection portion 32 are separated by a wall, the toner storage 31 stores toner discharged from the discharge port 36, and the waste toner collection portion 32 collects the waste toner received from the collection port 37. The toner storage 31 includes an upper case 58 and a lower case 59.

The toner storage 31 further includes a supply screw 34 as a conveyor that rotates clockwise in FIGS. 2 and 9 and the first stirrer 33A and the second stirrer 33B that serve as stirrers and two rotators and rotate clockwise in FIGS. 2 and 9.

The supply screw 34 as the conveyor discharges a target amount of toner stored in the toner storage 31 from the discharge port 36 according to a drive timing and rotation duration controlled by a controller. In the present embodiment, the supply screw 34 works as the conveyor that conveys the toner stored inside the toner storage 31 of the toner container 30 in a predetermined conveyance direction along the rotation axis direction that is the Y direction. The supply screw 34 transports the toner to the discharge port 36 formed at the end portion in the Y direction.

The first stirrer 33A and the second stirrer 33B serving as the rotators rotate in a predetermined direction about a rotation shaft 33*a* and stir toner stored in the toner storage 31 to prevent toner from aggregating. As illustrated in FIG. 9, the first stirrer 33A and the second stirrer 33B each include a flap 33*c* formed of a thin plate-like Mylar™ (i.e. polyethylene terephthalate (PET) film) or the like (i.e. the flap is a flexible member) and plate-like holders 33*b* that are rigid bodies. The flap 33*c* rotates on the rotation shaft 33*a* that is the center of rotation. The holder 33*b* is disposed across the rotation shaft 33*a*. The flap 33*c* is sandwiched and held by the holders 33*b*. A housing of the toner container 30 rotatably supports both ends of the first stirrer 33A and both ends of the second stirrer 33B in each of the axial directions through a pair of bearings. In the flaps 33*c* of the first stirrer 33A and the second stirrer 33B serving as the rotators, one end of the flap 33*c* is fixed on a support face 33*b*1 of the holder 33*b* by thermal caulking, and the other end of the flap 33*c* is inserted into holes 33*b*2 of the holder 33*b* and held by the holder 33*b*. This is described below with reference to FIGS. 11 to 13.

The waste toner collection portion 32 that is a developer collection portion includes the waste toner conveying screw 35 that rotates counterclockwise in FIG. 2. The waste toner conveying screw 35 conveys waste toner so that the waste toner that flows through the collection port 37 does not accumulate under the collection port 37 and is evenly distributed in the waste toner collection portion 32.

In the present embodiment, as the operator pivots a lever 39 of the toner container 30 attached to the process cartridge 10 (or the image forming apparatus 100), the first shutter 40 in the discharge port 36 and the second shutter 41 in the collection port 37 simultaneously open and close. In addition to the first shutter 40 and the second shutter 41, the inlet port 64 and the outlet port 74 of the process cartridge 10 also simultaneously open and close. Therefore, open and close failures are prevented in the first shutter 40, the second shutter 41, the first cartridge shutter 63, and the second cartridge shutter 73.

The lever 39 is arranged to be exposed to the outside as illustrated in FIG. 3B and operable by the operator when the cover 90 is opened in the main body of the image forming apparatus 100 in which the toner container 30 is installed.

The toner container 30 further includes a first rotation portion 42 as illustrated in FIG. 5. In the width direction of the toner container 30, the first rotation portion 42 is disposed opposite the lever 39 and the second rotation portion 43 which are illustrated in FIG. 8. The first rotation portion 42 is coupled to the second rotation portion 43 via a shaft and rotates together with the lever 39, the second rotation portion 43, and the shaft.

The configuration and operations of the first stirrer 33A and the second stirrer 33B that serve as the rotators in the toner container 30 serving as the developer container according to the present embodiment are described in detail below.

As described above with reference to FIG. 9, the toner container 30 according to the present embodiment includes the first stirrer 33A and the second stirrer 33B serving as the rotators that each rotate on the rotation shaft 33*a* in a predetermined rotation direction, that is, clockwise in FIG. 9. The first stirrer 33A and the second stirrer 33B that serve as the rotators stir the toner in the toner storage 31 and prevent the toner from adhering to the inner wall surface of the toner storage 31.

Figure 11:
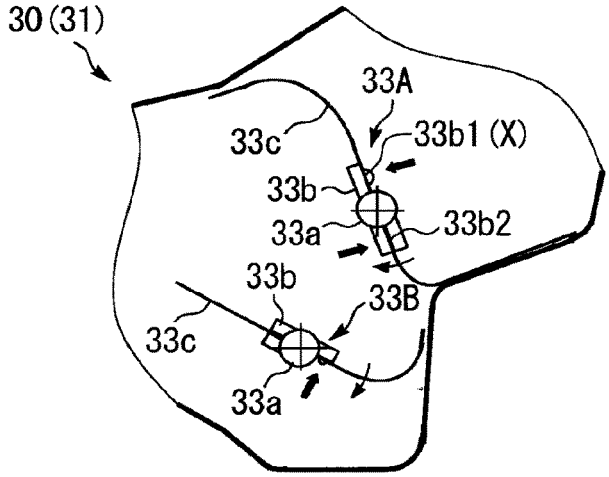
FIG. 11 is a schematic view illustrating a main part of the toner container of FIG. 9.

As illustrated in FIGS. 11 and 12, the first stirrer 33A and the second stirrer 33B serving as the rotators each include the rotation shaft 33*a*, a holder 33*b*, a flap 33*c*. The first stiffer 33A and the second stirrer 33B are different in overall size, installation position, number of teeth of tip portions having teeth like comb, and the like, but the first stirrer 33A and the second stirrer 33B include the rotation shaft 33*a*, the holder 33*b*, and the flaps 33*c* and have a similar structure, so some of the explanation is omitted as appropriate.

The rotation shaft 33*a* is rotatably held by bearings on side walls located at both ends of the toner storage 31 of the toner container 30 in the width direction of the toner container 30. In the present embodiment, the rotation shaft 33*a* and the holder 33*b* are resin-molded and formed as one component (see FIG. 13).

The flap 33*c* is across the rotation shaft 33*a* and extends in one radial direction as a first radial direction and the other radial direction as a second radial direction. The flap 33*c* slides on the inner wall surface of the toner storage 31 of the toner container 30. In other words, the flap 33*c* is formed to extend in two directions shifted by 180 degrees in the rotation direction with the rotation shaft 33*a* interposed therebetween. In the present embodiment, the flap 33*c* is a sheet-shaped member made of polyethylene terephthalate (PET) having a thickness of about 0.05 to 0.1 mm. The holder 33*b* is a rigid plate-shaped member formed of a resin material or the like to hold the flap 33*c*. The holder 33*b* extends from the center of the rotation shaft 33*a* in the radial direction and holds the center of the flap 33*c* (which is the center of the rotation shaft 33*a*).

With reference to FIG. 12, in the first stirrer 33A and the second stirrer 33B that serve as the rotators according to the present embodiment, one radial portion of the flap 33*c*, that is, a first radial flap 33*c*1 is fixed on the support face 33*b*1 of the holder 33*b* by thermal caulking, and the other radial portion of the flap 33*c*, that is, a second radial flap 33*c*2 is inserted into the hole 33*b*2 of the holder 33*b*. As a result, the holder 33*b* holds the flap 33*c*.

In addition, the first stirrer 33A and the second stirrer 33B that serve as the rotators rotates such that the support face 33*b*1 of the holder 33*b* faces the downstream side in the rotation direction, that is, toward the rotation direction. That is, the first stirrer 33A and the second stirrer 33B rotate clockwise in FIGS. 11 and 12B.

Specifically, the flap 33*c* is across the rotation shaft 33*a*, and the holder 33*b* supports one end of the one radial portion of the flap 33*c*, that is, the first radial flap 33*c*1, and one end of the other radial portion of the flap 33*c*, that is, the second radial flap 33*c*2, like cantilevers. Thus, the holder 33*b* holds the flap 33*c*.

The holder 33*b* has the support face 33*b*1 formed on one radial portion extending from the rotation shaft 33*a* in the one radial direction as the first radial direction and the holes 33*b*2 formed the other radial portion extending from the rotation shaft 33*a* in the other radial direction as the second radial direction.

Figure 12A:
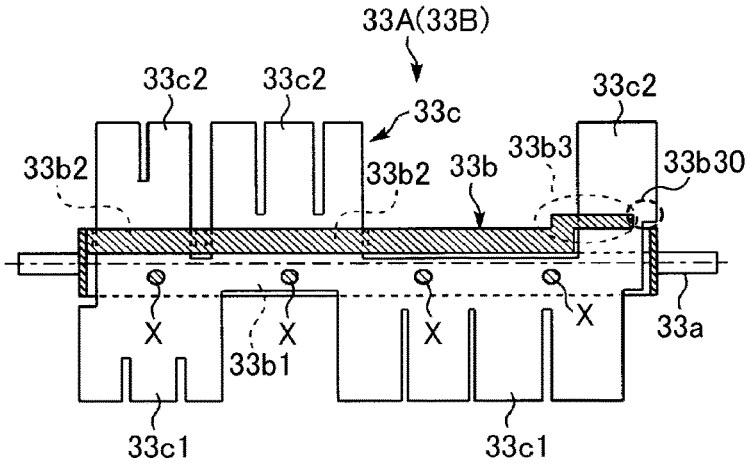
FIG. 12A is a top view of a stirrer according to an embodiment of the present disclosure.

The support face 33*b*1 is a flat surface extending from the center of the rotation, which is illustrated by the dashed line in FIG. 12A, in the one radial direction. A plurality of caulking portions X (i.e. four caulking portions X in the present embodiment) for thermal caulking are formed on the support face 33*b*1 at intervals in the rotation axis direction to hold the first radial flap 33*c*1 on the support face 33*b*1.

More specifically, the one radial portion of the flap 33*c*, that is, the first radial flap 33*c*1 has a plurality of through-holes 33*c*5 (see FIG. 13) spaced out in the rotation axis direction. The holder 33*b* has a plurality of bosses 33*b*5 (see FIG. 13) on the support face 33*b*1. The plurality of bosses 33*b*5 are fitted into the through-holes 33*c*5 and thermally melted to form the caulking portions X. Thus, the holder 33*b* fixes the one radial portion of the flap 33*c*, that is, the first radial flap 33*c*1 on the support face 33*b*1.

Figure 12B:
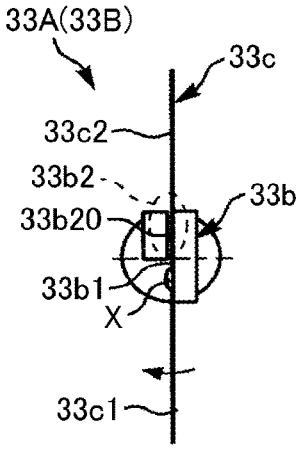
FIG. 12B is a cross-sectional view of the stirrer of FIG. 12A.

As illustrated in FIG. 12B, the hole 33*b*2 of the holder 33*b* is opened in a direction substantially orthogonal to the support face 33*b*1 and has two inner surfaces facing each other in the direction substantially orthogonal to the support face 33*b*1. One inner surface 33*b*20 of the two inner surfaces is a flat surface connected to the support face 33*b*1.

That is, in the hole 33*b*2, the second radial flap 33*c*2 is sandwiched between a first inner surface 33*b*20 connected to the support face 33*b*1 and a second inner surface facing the first inner surface 33*b*20 with a gap and held by the hole 33*b*2. The gap (in other words, an opening height) between the first inner surface 33*b*20 and the second inner surface is set to be substantially equal to or larger than the thickness of the flap 33*c* (i.e. the second radial flap 33*c*2), preferably set to be slightly larger than the thickness of the flap 33*c*.

Figure 13A:
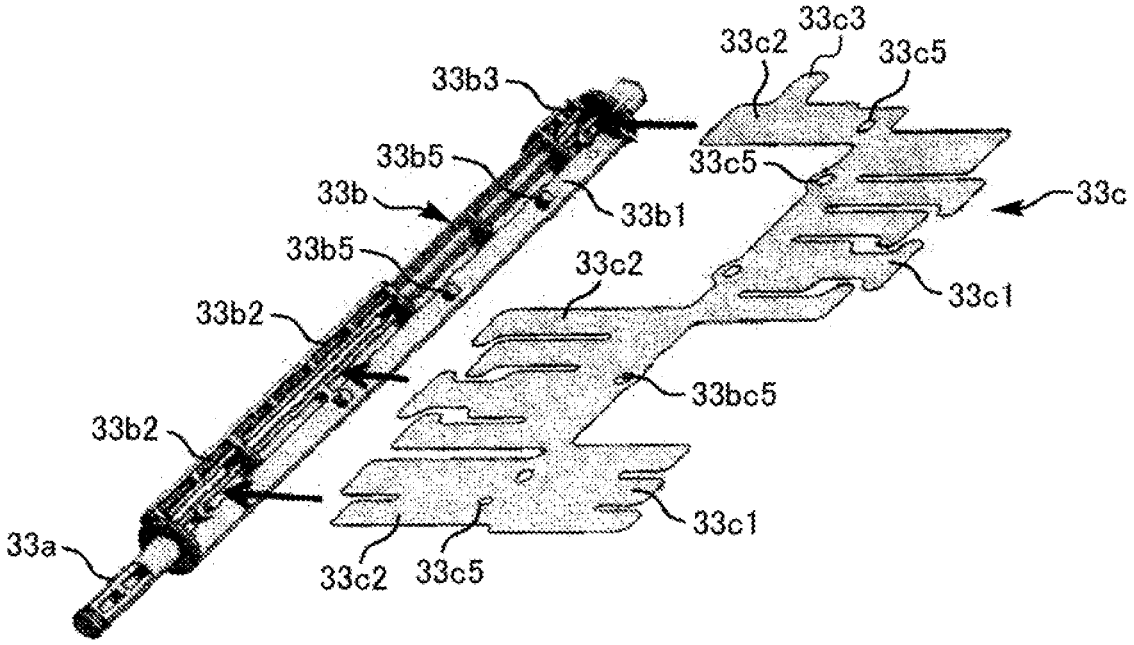
FIGS. 13A and 13B are perspective views illustrating a manufacturing process of the stirrer of FIGS. 12A and 12B.
Figure 13B:
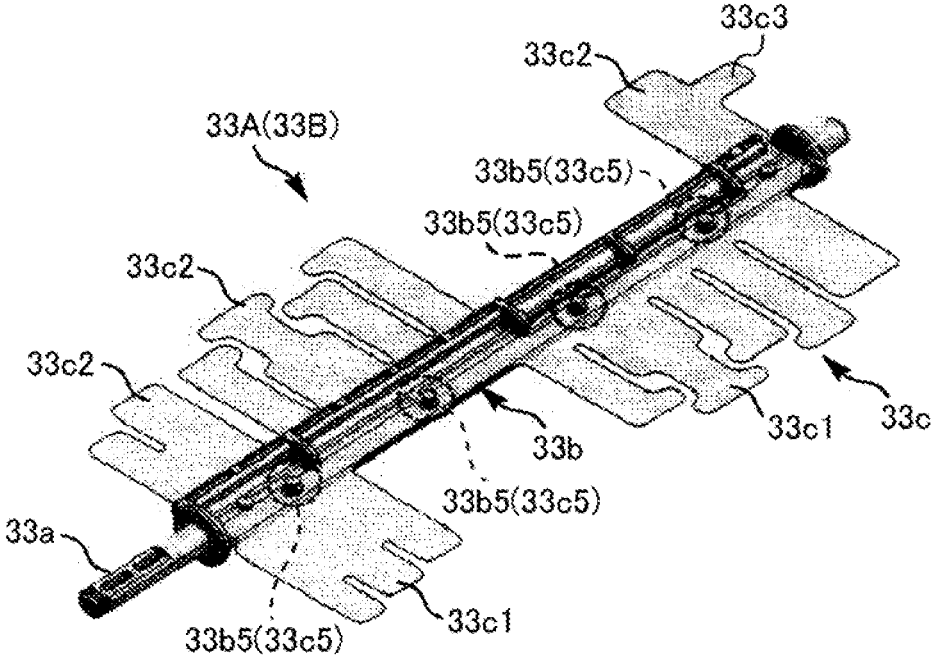

With reference to FIGS. 13A and 13B, a manufacturing process of the first stirrer 33A and the second stirrer 33B is described below.

Initially, as illustrated in FIG. 13A, the flap 33*c* is moved in a direction indicated by arrow, and the second radial flaps 33*c*2 are inserted into the holes 33*b*2 of the holder 33*b*. Next, as illustrated in FIG. 13B, the bosses 33*b*5 of the holder 33*b* are fitted in the through-holes 33*c*5 of the first radial flap 33*c*1. Subsequently, thermal caulking is performed on the bosses 33*b*5 fitted into the through-holes 33*c*5 to form the caulking portions X.

Thus, the flap 33*c* (including the first radial flap 33*c*1 and the second radial flap 33*c*2) is held by the holder 33*b* (including the support face 33*b*1 and the holes 33*b*2), and the manufacturing process of the first stirrer 33A and the second stirrer 33B is completed.

As described above, in the first stirrer 33A and the second stirrer 33B according to the present embodiment, the one radial portion of the flap 33*c*, that is, the first radial flap 33*c*1 is fixed on the support face 33*b*1 of the holder 33*b* by thermal caulking, and the other radial portion of the flap 33*c*, that is, the second radial flap 33*c*2 is inserted into the hole 33*b*2 of the holder 33*b*. As a result, the holder 33*b* holds the flap 33*c*. Additionally, each of the first stirrer 33A and the second stirrer 33B rotates so that the support face 33*b*1 faces the downstream side of the rotation direction, not the upstream side. Stirred toner applies a large force in a direction indicated by each thick black arrow in FIG. 11 to the calking portions X in which the first radial flap 33*c*11 is fixed on the support face 33*b*1 by thermal caulking. However, the large force presses the flap 33*c* against the support face 33*b*1 and does not separate the flap 33*c* from the support face 33*b*1. As a result, a disadvantage that the flap 33*c* separates from the first stirrer 33A or the second stirrer 33B is not caused.

Figure 14A:
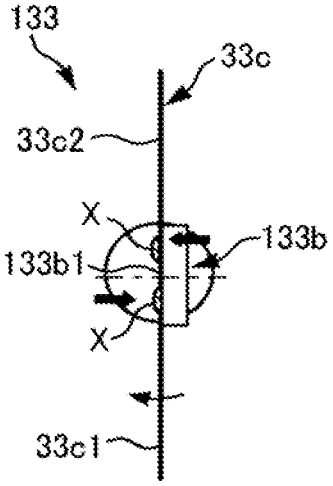
FIGS. 14A and 14B are cross-sectional views illustrating a stirrer according to a comparative example.
Figure 14B:
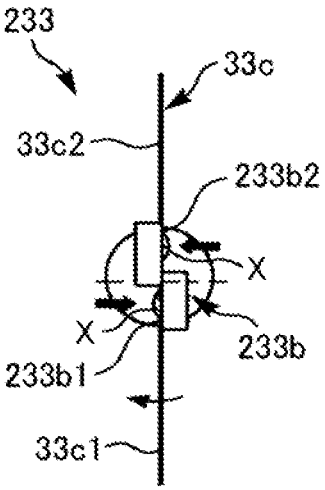

With reference to FIG. 14B, a comparative example is described. In a stirrer 133 illustrated in FIG. 14B, one radial portion of the flap 33*c*, that is, the first radial flap 33*c*1 is fixed on the support face 133*b*1 of the holder 133*b* by thermal caulking, and the other radial portion of the flap 33*c*, that is, the second radial flap 33*c*2 is also fixed on the support face 133*b*1 by the thermal caulking. The above-described configuration of the holder 133*b* is simple and may reduce a production cost. However, in the stirrer 133 illustrated in FIG. 14A, the stirred toner applies the large force to the second radial flaps 33*c*2 fixed on the calking portions X in a direction in which the large force separates the second radial flaps 33*c*2 from the support face 133*b*1. The large force easily separates the flap 33*c* from the holder 133*b*. The stirrer 133 from which the flap 33*c* is separated does not function as the stirrer.

In contrast, in the first stirrer 33A and the second stirrer 33B according to the present embodiment, the caulking portion X is formed on the one radial portion of the flap 33*c*, that is, the first radial flap 33*c*1 and not formed on the other radial portion of the flap 33*c*, that is, the second radial flap 33*c*2. The other radial portion of the flap 33*c*, that is, the second radial flap 33*c*2 is sandwiched and held by the hole 33*b*2. As a result, the above-described disadvantage is not likely to occur. That is, even if the stirred toner applies the large force to the one radial portion of the flap 33*c* fixed at the caulking portions X, the large force presses the one radial portion of the flap 33*c* fixed at the caulking portions X against the support face 33*b*1 and does not separate the one radial portion of the flap 33*c* fixed at the caulking portions X from the support face 33*b*1. The large force does not break the first radial flap 33*c*1. In addition, since the second radial flap 33*c*2 is sandwiched and held by the hole 33*b*2, the large force due to the stirred toner does not separate the second radial flap 33*c*2 held by the hole 33*b*2 from the holder 33*b*.

With reference to FIG. 14B, another comparative example is described. In a stirrer 233 illustrated in FIG. 14B, one radial portion of the flap 33*c*, that is, the first radial flap 33*c*1 is fixed on a first support face 233*b*1 of a holder 233*b* by thermal caulking, and the other radial portion of the flap 33*c*, that is, the second radial flap 33*c*2 is also fixed on a second support face 233*b*2 by the thermal caulking. The first support face 233*b*1 and the second support face 233*b*2 face the downstream side in the rotation direction of the stirrer 233. The stirred toner applies the large force to the first radial flap 33*c*1 and the second radial flap 33*c*2, but the large force presses the first radial flap 33*c*1 and the second radial flap 33*c*2 against the first support face 233*b*1 and the second support face 233*b*2, respectively. As a result, the large force does not separate the first radial flap 33*c*1 and the second radial flap 33*c*2 from the first support face 233*b*1 and the second support face 233*b*2, respectively and not break the caulking portions X. However, the above-described configuration of the holder 233*b* is complicated and increases the production cost of the stirrer 233.

In contrast, in the first stirrer 33A and the second stirrer 33B according to the present embodiment, the caulking portion X is formed on the one radial portion of the holder 33*b*, that is, on the first radial flap 33*c*1, and the hole 33*b*2 is formed on the other radial portion of the holder 33*b* on which the second radial flap 33*c*2 is disposed. Accordingly, the production cost in the present embodiment is relatively lower than the one in the above-described comparative example.

As illustrated in FIG. 12A, an end of the one radial portion of the flap 33*c* that is the first radial flap 33*c*1 in the rotation axis direction projects from an end of the other radial portion of the flap 33*c* that is the second radial flap 33*c*2 in the rotation axis direction toward an end of the rotation shaft 33*a* that is the left side in FIG. 12A.

This is because the other radial portion of the holder 33*b* has the hole 33*b*2, and the end of the second radial flap 33*c*2 that is inserted into the hole 33*b*2 does not project outside from the hole 33*b*2 in the rotation axis direction, that is, from the left end of the hole 33*b*2 in FIG. 12A. In contrast, an end position of the first radial flap 33*c*1 in the rotation axis direction is not limited because the first radial flap 33*c*1 is fixed on the support face 33*b*1 of the one radial portion of the holder 33*b* by the thermal caulking. Accordingly, the first radial flap 33*c*1 projects toward the end of the rotation shaft to reduce toner agitation failure at the end portion of the toner container in the rotation axis direction.

With reference to FIG. 12A, the holder 33*b* according to the present embodiment has a plurality of holes 33*b*2 and 33*b*3 disposed at intervals in the rotation axis direction. This is because each of the first stirrer 33A and the second stirrer 33B according to the present embodiment has a plurality of the second radial flaps 33*c*2 disposed at intervals in the rotation axis direction. Specifically, three separate second radial flaps 33*c*2 are inserted into the three holes 33*b*2 and 33*b*3, respectively and held. With reference to FIG. 12A, the plurality of holes 33*b*2 and 33*b*3 according to the present embodiment include the hole 33*b*3 at an end portion of the holder 33*b* in the rotation axis direction, that is, the hole 33*b*3 disposed right side in FIG. 12A. The hole 33*b*3 has a slit 33*b*30 at an end of the hole 33*b*3 in the rotation axis direction.

The slit 33*b*30 formed in the hole 33*b*3 as described above enables an end portion of the second radial flap 33*c*2 that is inserted into the hole 33*b*3 to project toward the end of the rotation shaft from the hole 33*b*3, that is, right side from the hole 33*b*3 in FIG. 12A. As a result, even when it is difficult to design the first radial flap 33*c*1 projecting toward the end of the rotation shaft, the second radial flap 33*c*2 can be designed to project toward the end of the rotation shaft, which reduces the toner agitation failure at the end portion of the toner container in the rotation axis direction. The second radial flap 33*c*2 may have a projection 33*c*3 as illustrated in FIGS. 13A and 13B. Pinching the projection 33*c*3 helps setting the flap 33*c* to the holder 33*b*.

As illustrated in FIG. 12, the flaps 33*c* of the first stirrer 33A and the second stirrer 33B have a plurality of slits having start points away from the holder 33*b* in the radial direction, and the plurality of slits are spaced out each other in the rotation axis direction.

The flap 33*c* having the slit extending in the radial direction as described above makes smaller noise that occurs when the flap 33*c* hits and passes through the inner surface of the toner container 30 than the flap 33*c* not having the slit.

The flap 33*c* according to the present embodiment includes a plurality of comb-teeth tip portions disposed at intervals in the rotation axis direction. The comb-teeth tip portion has the slit. The comb-teeth tip portion extending in the one radial direction exists in a portion corresponding to the interval between the comb-teeth tip portions extending the other radial direction. That is, as illustrated in FIG. 12A, the comb-teeth tip portions are disposed alternately above and below the rotation shaft 33*a* along the rotation axis direction.

Compared with arranging all of the plurality of comb-teeth tip portions in the same radial direction, alternately arranging the plurality of comb-teeth tip portions in the different radial directions as described above can reduce load variation during one rotation of the first stirrer 33A and the second stirrer 33B.

As described above, each of the first stirrer 33A and the second stirrer 33B serving as the rotator according to the present embodiment includes the rotation shaft 33*a*, the first radial flap 33*c*1 extending from the rotation shaft 33*a* in the one radial direction as the first radial direction, the second radial flap 33*c*2 extending from the rotation shaft 33*a* in the other radial direction as the second radial direction, and the holder 33*b* to hold the first radial flap 33*c*1 and the second radial flap 33*c*2. The holder 33*b* has the support face 33*b*1 on which the first radial flap 33*c*1 is fixed by the thermal caulking and the hole 33*b*2 into which the second radial flap 33*c*2 is inserted to hold the second radial flap 33*c*2. The rotator rotates so that the support face 33*b*1 of the holder 33*b* faces toward the rotation direction of the rotator.

The above-described configuration can prevent the flap 33*c* from separating from each of the first stirrer 33A and the second stirrer 33B that serves as the rotator.

In the above-described embodiments, the present disclosure is applied to the process cartridge 10 as a single unit including the photoconductor drum 1 serving as an image bearer, the charging roller 4 serving as a charger, the developing device 5, the cleaner 2, and the waste toner conveyor 6. However, the present disclosure is not limited to the embodiments described above and may be applied to the image forming apparatus in which each of the above-described devices (i.e., the photoconductor drum 1, the charging roller 4, the developing device 5, the cleaner 2, and the waste toner conveyor 6) is removably installed as a single unit into the image forming apparatus 100.

In such configurations, similar effects to the embodiments described above are also attained.

It is to be noted that the term "process cartridge" used in the above means a removable device (or a removable unit) including the image bearer and at least one of the charger to charge the image bearer, the developing device to develop latent images on the image bearer, and the cleaner to clean the image bearer that are united together, and is designed to be removably installed as a united part in the apparatus body of the image forming apparatus.

In the above-described embodiment, the present disclosure is applied to the toner container 30 serving as the developer container included in the image forming apparatus 100 that performs monochrome image formation. Alternatively, the present disclosure may be applied readily to a toner container serving as the developer container included in a color image forming apparatus.

In the above-described embodiments, the present disclosure is applied to the toner container 30 serving as the developer container indirectly installed in and removed from the image forming apparatus 100 via the process cartridge 10. Alternatively, the present disclosure may be applied to a toner container serving as the developer container directly installed in and removed from the image forming apparatus 100 without going through the process cartridge 10.

In the above-described embodiments, the present disclosure is applied to the toner container 30 serving as the developer container to store toner that is the one-component developer and supply the toner to the developing device 5 for a one-component developing method. Alternatively, the present disclosure may be applied to a toner container serving as the developer container to supply toner to the developing device 5 that stores two-component developer including toner and carrier for a two-component developing method.

In the above-described embodiments, the present disclosure is applied to the toner container 30 serving as the developer container in which toner is stored and collected. Alternatively, the present disclosure may be applied to the developer container in which a two-component developer is stored and collected. The two-component developer is a mixture of toner and carrier. In this case, a developing device employs the two-component developing method.

In the above-described embodiments, the present disclosure is applied to the toner container 30 serving as the developer container including the toner storage 31 and the waste toner collection portion 32 as a single unit. Alternatively, the present disclosure may be applied to a toner container serving as the developer container including only the toner storage.

Any of the cases described above exhibits the same advantages as the advantages of the present embodiment.

In the above-described embodiments, the present disclosure is applied to the first stirrer 33A and the second stirrer 33B serving as the rotators disposed in the toner storage 31 of the toner container 30 to supply toner to the developing device 5, but the application of the present disclosure is not limited to this. Alternatively, the rotator (i.e. the stirrer) according to the present disclosure may be disposed in a developing device to store toner and develop a latent image formed on an image bearer to a toner image (for example, the developing device 5 in the above-described embodiment). Further, the rotator (i.e. the stirrer) according to the present disclosure may be disposed in other toner containers such as the cleaner 2 or the waste toner collection portion 32 in the above-described embodiment included in the image forming apparatus.

In the present embodiment, the present disclosure is applied to the first stirrer 33A and the second stirrer 33B serving as the rotator, but the present disclosure may be applied to the rotator that does not function as the stirrer.

Any of the cases described above exhibits the same advantages as the advantages of the present embodiment.

The present disclosure is not limited to the above-described embodiments, and the configuration of the present embodiment can be appropriately modified other than suggested in each of the above embodiments within a scope of the technological concept of the present disclosure. Further, features of components of the embodiments, such as the number, the position, and the shape are not limited the embodiments and thus may be preferably set.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. Further, features of components of the embodiments, such as the number, the position, and the shape are not limited the embodiments and thus may be preferably set.

What is claimed is:

1. A rotator for an image forming apparatus comprising:

a rotation shaft;

a first radial flap extending from the rotation shaft in a first radial direction;

a second radial flap extending from the rotation shaft in a second radial direction; and a holder holding the first radial flap and the second radial flap, the holder having:

a support face facing toward a rotation direction of the rotator, the support face being configured to fix the first radial flap by thermal caulking and a hole configured to insert a part of the second radial flap to hold the second radial flap, wherein the hole comprises two inner surfaces facing each other in a direction orthogonal to the support face, and one of the two inner surfaces is a flat surface connected to the support face.

2. The rotator according to claim 1, wherein a part of the holder extending from the rotation shaft in the first radial direction includes the support face and supports one end of the first radial flap in the first radial direction, and a part of the holder extending from the rotation shaft in the second radial direction has the hole and supports one end of the second radial flap in the second radial direction.

3. The rotator according to claim 2, wherein the hole opens toward the direction orthogonal to the support face.

4. The rotator according to claim 1, wherein the first radial flap has a plurality of through-holes spaced apart in a rotation axis direction of the rotator, and wherein the holder includes a plurality of bosses fitting into the plurality of through-holes and thermally melted on the support face to fix the first radial flap on the support face.

5. The rotator according to claim 1, wherein an end of the first radial flap in a rotation axis direction of the rotator projects beyond an end of the second radial flap in the rotation axis direction toward an end of the rotation shaft in the rotation axis direction.

6. The rotator according to claim 1, wherein the holder has a plurality of holes including the hole and spaced apart in a rotation axis direction of the rotator, and wherein one hole of the plurality of holes disposed at an end of the holder in the rotation axis direction has a slit at an end of the one hole in the rotation axis direction.

7. A developer container comprising the rotator according to claim 1.

8. A developing device configured to develop a latent image formed on an image bearer to form a toner image, the developing device comprising the rotator according to claim 1.

9. A process cartridge configured to be detachably installed to a body of an image forming apparatus, the process cartridge comprising the rotator according to claim 1.

10. An image forming apparatus comprising the rotator according to claim 1.

11. The rotator according to claim 1, wherein the second radial flap is configured to be sandwiched between the two inner surfaces separated with a gap and held by the hole.

12. The rotator according to claim 11, wherein the gap between the two inner surfaces is configured to be substantially equal to or larger than a thickness of the second radial flap.

* * * * *